US005423713A

United States Patent [19]

Mishima

[11] Patent Number: 5,423,713

[45] Date of Patent: Jun. 13, 1995

[54] POWDER BEAM ETCHING METHOD

[75] Inventor: Akio Mishima, Kanagawa, Japan

[73] Assignee: Sony Corporation, Japan

[21] Appl. No.: 138,269

[22] Filed: Oct. 20, 1993

[30] Foreign Application Priority Data

Oct. 30, 1992 [JP] Japan ..... 4-316583

[51] Int. Cl.[6] ..... B24C 1/04

[52] U.S. Cl. ..... 451/36; 451/37; 451/38; 451/75; 451/102

[58] Field of Search ..... 51/317, 318, 319, 320, 51/321, 410, 427; 451/36, 37, 38, 39, 40, 75, 90, 102

[56] References Cited

U.S. PATENT DOCUMENTS 4,044,505 8/1977 Meyer et al. ..... 51/5 R
4,272,612 6/1981 Oliver ..... 51/319
4,281,485 8/1981 Charity, III ..... 51/310
4,569,720 2/1986 Schmitkons et al. ..... 51/281 R
4,834,833 5/1989 Palmer ..... 51/310
5,031,373 7/1991 Montgomery ..... 51/317
5,197,234 3/1993 Gillenwater ..... 51/319

*Primary Examiner*—Bruce M. Kisliuk
*Assistant Examiner*—Eileen P. Morgan
*Attorney, Agent, or Firm*—Ronald P. Kananen

[57] ABSTRACT

In a powder beam etching method, a nozzle for injecting fine particles and a work are moved relative to each other in two perpendicular directions, viz., a scanning direction and a feed pitch direction during each scanning motion. During each return scanning motion the path followed is arranged to fall in between the path of the preceding forward motion.

6 Claims, 6 Drawing Sheets

POWDER BEAM ETCHING METHOD

BACKGROUND OF THE INVENTION

1. Field of the Invention

The present invention relates to a powder beam etching method for injecting fine particles from a nozzle against a surface of a workpiece (hereinafter referred to as the work) for etching it.

2. Description of the Related Art

A nozzle used in conventional powder beam etching has a rectangular type nozzle 51 having a rectangular opening portion such as shown in FIG. 5. In the case where powder 52 is injected from the rectangular nozzle 51 against a surface 53 of a work 51, a non-uniform distribution of the etching depth tends to occur in the manner shown in FIG. 5. A range or width A wherein the etching depth remains relatively uniform depends upon the type of nozzle 51 but is normally 0.5 to 5 mm. Further, the amount of the powder 52 which is injected from the nozzle 51 per unit injection time varies as shown in FIG. 6. For example, in the case wherein the target injection amount is 10 g/min, the amount has been found to vary in the range of about 10 g±2 g. Namely, there tends to be a variation of ±20%.

In order to suppress the above-described variation in etching depth, in the conventional technique, as shown in FIG. 7, after the nozzle 51 have been repeatedly scanned and pitch-fed to etch the entire surface 53 of the work, the nozzle is moved back to the scanning starting point along exactly the same path. As a result, it is possible to improve the uniformity of the etching depth up to ±14%.

However, in case of the fine etching, in many cases, a uniformity in etching depth within ±10% is required. This requirement cannot be met by the conventional etching. As a result, the application of the powder beam etching is unduly limited.

In view of this defect, an object of the present invention is to provide a powder beam etching method which is capable of enhancing uniformity in etching depth.

SUMMARY OF THE INVENTION

According to the present invention, there is provided a powder beam etching method for etching work by injecting fine particles onto the work, comprising the steps of: firstly etching the work through a one-way scanning motion attained by moving either a nozzle for injecting the fine particles onto the work, the work, or both and the work and the nozzle, relative to each other. After the surface of the work has been etched once in this manner, a second etching of the work is carried out through a return scanning motion attained by moving the nozzle and the work relative to each other in a manner wherein the path followed falls in between the etching path followed during the first etching.

Since the surface of the work is etched along different forward and return scanning paths, it is possible to enhance the uniformity in etching depth within about ±8%.

A variant of this technique resides in performing the etching process a plurality of times (N) in a manner wherein feed pitch (P2) of the scan of each subsequent etching process is a multiple (N) of the feed pitch (P1) of the initial scan of the first etching process.

Since the feed pitch of the second etching scan is lengthened, it is possible to shorten the time needed for each subsequent scanning, while making it possible to suppress the variation of the injection amount of the fine particles. As a result, it is possible to enhance the uniformity in etching depth within about ±6%.

In the disclosed embodiments, by keeping the feed pitch within a range of 0.5 to 5 mm, it is possible to further enhance the uniformity in etching depth corresponding to the uniform range of the etching depth.

Further, if a scanning speed is in the range of 10 to 100 mm/sec, it is possible, with the lower limit of 10 mm/sec, to suppress the variation in the injection amount of the fine particles. Also, below the upper limit of 100 mm/sec, it is possible to prevent the holder holding the work from falling down.

In brief, the powder beam etching method according to the invention is such that, a nozzle for injecting fine particles and a work are moved relative to each other in two perpendicular directions (viz., a scanning direction) and a feed pitch direction, during each scanning motion. A return way scanning motion is effected in a manner wherein the path followed in the return motion falls in between the path followed during the forward motion to thereby enhance the uniformity in etching depth.

DESCRIPTION OF THE PREFERRED EMBODIMENTS

Figure 1:
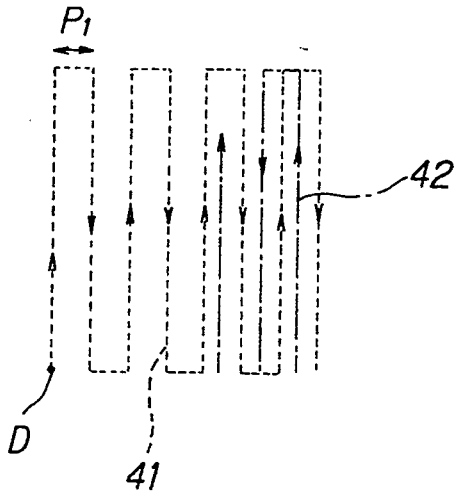
FIG. 1 is an illustration of movement paths of a nozzle according to a powder beam etching method of the invention.
Figure 2:
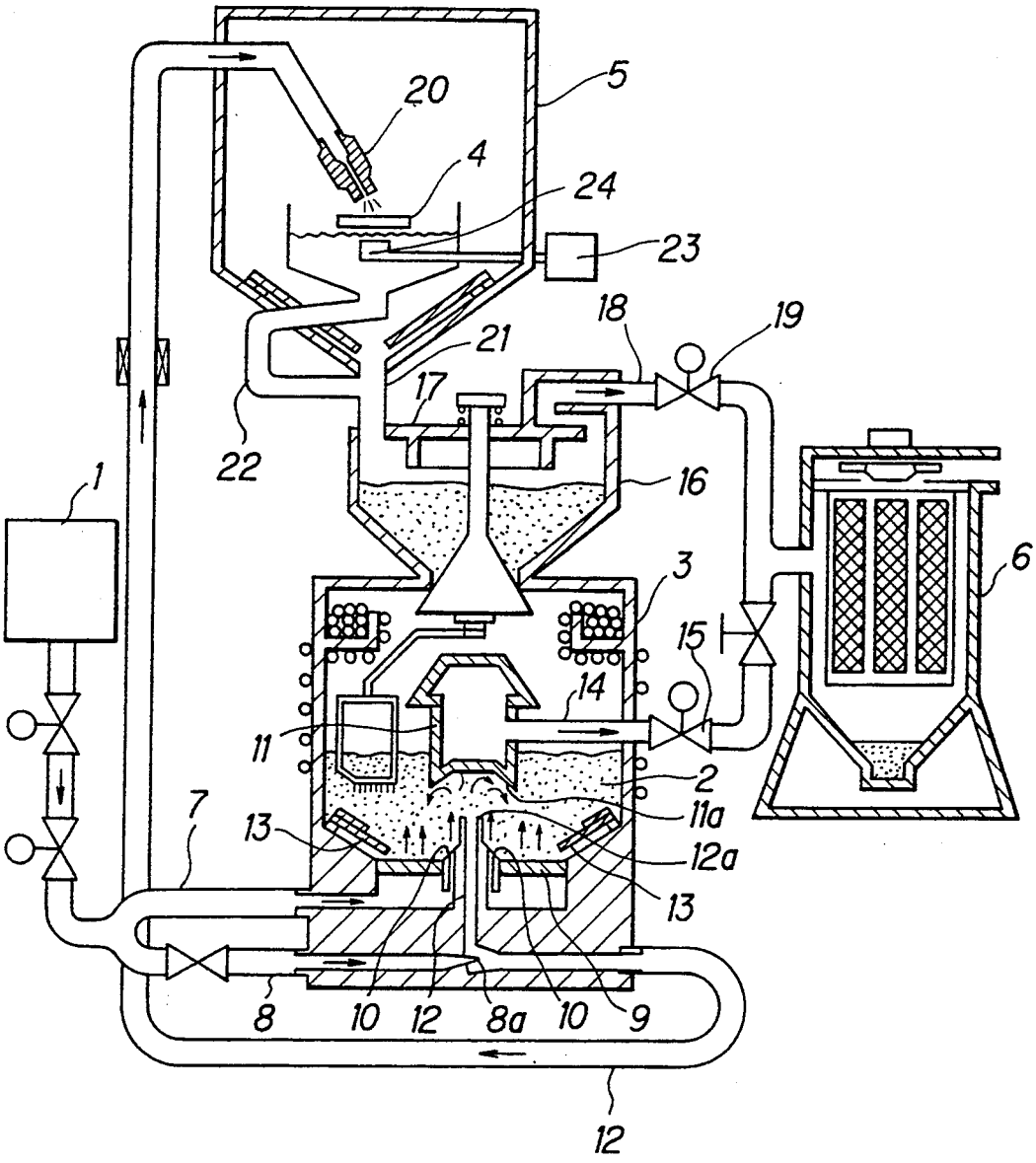
FIG. 2 is a cross-sectional view showing an example of an arrangement of the powder beam etching machine used in the method according to the present invention.

A powder beam etching machine in accordance with an embodiment of the invention will now be described with reference to the accompanying drawings.

The etching machine includes an air compressor 1, a mixing chamber 3 for mixing extremely fine particles (powder) 2 with compressed air fed from the air compressor 1, an injecting chamber 5 for injecting the fine particles as well as the compression air to a work 4, and an air discharge blower 6 for sucking the fine particles 2 from the injection chamber 5 and collecting the same.

In the thus arranged etching machine, the compressed air discharged from the air compressor 1 is supplied into both a first air supply conduit 7 and a second air supply conduit 8. The compressed air supplied into the first air supply conduit 7 is introduced into the mixing chamber 3 from an air ejection port 10 and/or a filter 9 provided in a bottom portion of the mixing chamber 3. In this case, the compressed air passes through the fine particles 2 so that the fine particles 2 are agitated by a so-called air vibrator effect. Some of the fine particles are collected in the vicinity of an inlet port 12*a* of a feed-out conduit 12 which is located adjacent a lower recesses portion 11*a* of a powder collector 11 that is provided within the mixing chamber 3.

During the agitation, the fine particles 2 are mechanically dispersed by vibrating members 13 provided at an inner bottom surface of the mixing chamber 3, thereby effectively continuing the air vibrator effect. A solenoid valve (electromagnetic valve) 15 is interposed midway along a conduit 14 connected to the powder collector 11 while a solenoid valve 19 is interposed midway along an air discharge pipe 18 connected to a lid 17 of a powder supply portion 16 located above the mixing chamber 3. These valves are controlled so that they are alternatively switched between their open and closed conditions and maintained either open or closed for a constant period. As a result, the pressure difference obtained by the opening/closing operations of the valves causes the fine particles 2 contained in the mixing chamber 3 to be further agitated.

On the other hand, the compressed air supplied into the second air supply conduit 8 is injected into the feed-out conduit 12 by way of an outlet port 8*a*. A vacuum produced by the flow of compressed air from the outlet port 8*a*, sucks the fine particles 2 that have been collected in the vicinity of the outlet port 8*a* into the feed-out conduit 12 and mixes them with the compressed air within the feed-out conduit 12. The mixture of the compressed air and the fine particles 2 in the feed-out conduit 12 is injected through a nozzle 20 within the injection chamber 5, so that the mixture is injected against a surface of the work 4 to thereby carry out the etching process. The spent fine particles 2 are returned back to the supply portion 16 through return pipes 21 and 22 connected to the injection chamber 5 for reuse.

Figure 3:
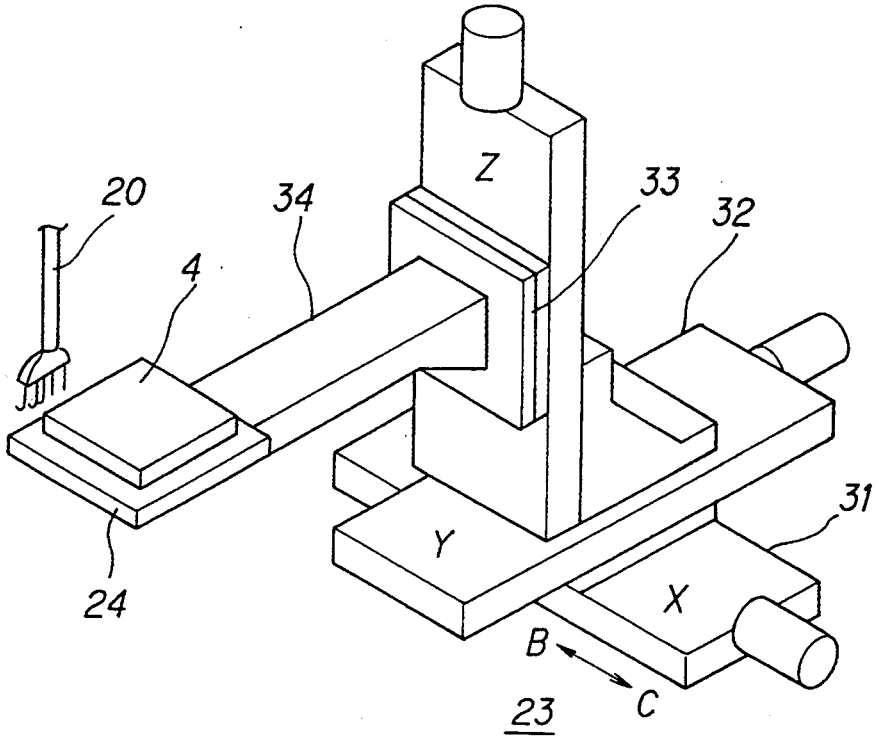
FIG. 3 is a perspective view showing a X–Y stage shown in FIG. 2.

The work 4 is supported on a holder 24 which in turn is moved in two mutually perpendicular directions by an X–Y stage 23. FIG. 3 shows an arrangement of the X–Y stage. In FIG. 3, a Y-axis table 32 that is movable horizontally in a direction perpendicular to an X-axis table 31 is provided on the X-axis table 31 which in turn is movable in a direction indicated by a two-headed arrow B–C. A Z-axis table 33 which is movable vertically is mounted on the Y-axis table 32. A horizontally extending table arm 34 is fixed at one end to the Z-axis table 33. The holder 24 on which the work 4 is to be loaded, is mounted to the other end of the table arm 34. It is to be noted that the respective tables 31, 32 and 33 are drivingly controlled by a driving unit (not shown).

The operation of the machine according to the foregoing embodiment will be explained with reference to FIG. 1. Scanning is carried out with respect to the nozzle 20 in the manner indicated by dotted lines 41, via the movement of the X-axis table 31. The scanning begins from a scanning starting point D that is displaced to one side of the work 4. Each time a predetermined scanning stroke has been carried out, the work 4 is advanced with respect to the nozzle 20 by a predetermined pitch P1 through the movement of the Y-axis table 32. These operations are repeated while injecting the fine particles 2 from the nozzle 20 for etching. When the nozzle 20 reaches a position at the opposite end of the work 4, movement in the reverse or opposite direction with respect to the nozzle 20, is started, and the scanning stroke and pitching movements are repeated as indicated by one-dot and dash lines 42 so as to follow a return path which passes between the previous path denoted by numeral 41.

Figure 5:
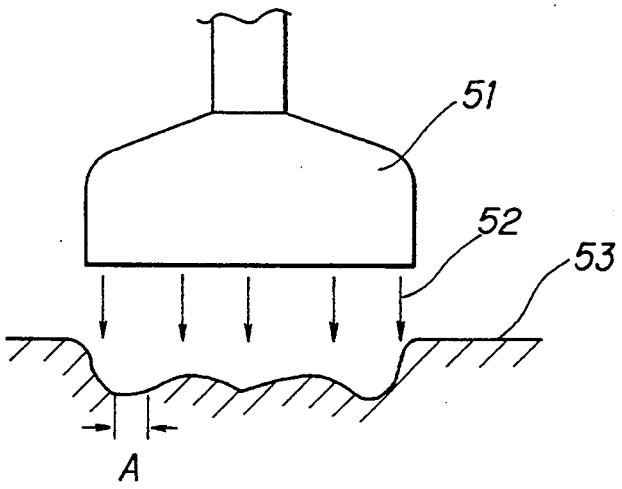
FIG. 5 is an illustration of a working shape obtained by an example of a nozzle used in the method of the invention.
Figure 6:
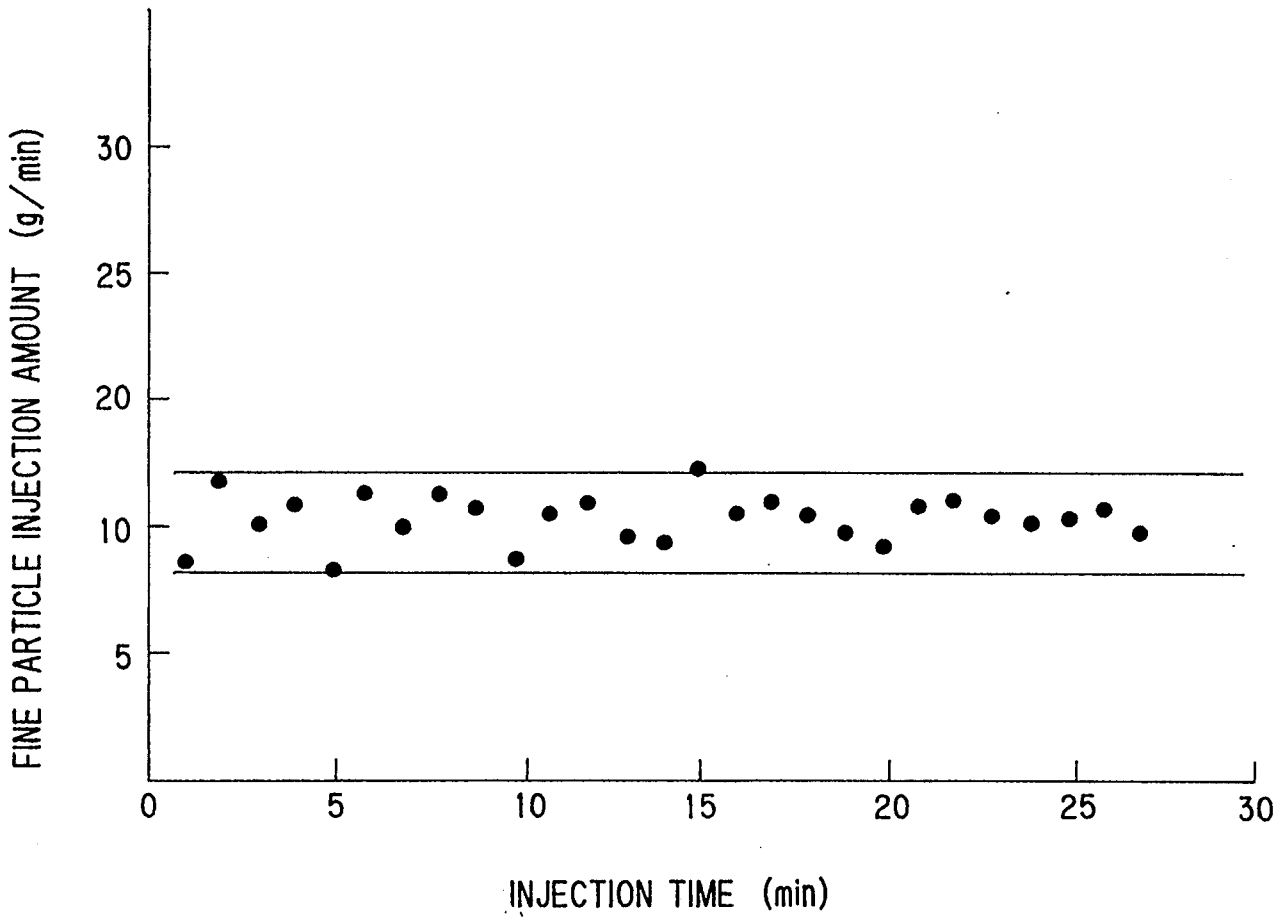
FIG. 6 is a graph showing a relationship between an injection time and an injection amount of fine particles.
Figure 7:
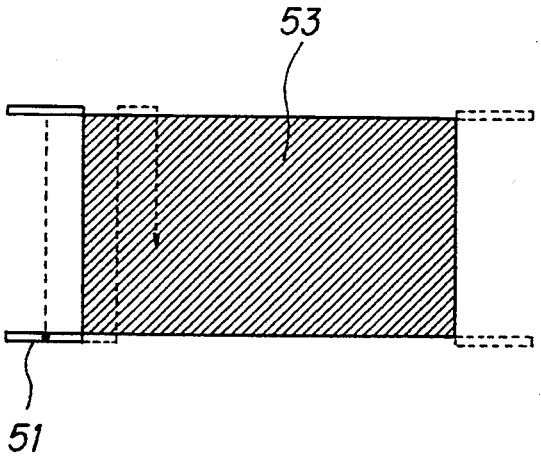
FIG. 7 PRIOR ART
FIG. 7 is an illustration showing one example of movement paths of a conventional nozzle.

According to this embodiment of the invention, it is possible to improve the uniformity in etching depth within about ±8% since the nozzle 20 effectively traces along different forward and return paths. The range of the uniform etching depth shown in FIG. 5 is varied depending upon a kind of the nozzle 20 and is 0.5 to 5 mm. Accordingly, the feed pitch should be set in the range of 0.5 to 5 mm to further improve the uniformity in depth etching. Also, if the scanning speed is kept above 10 mm/sec, the variation in injection amount of the fine particles 2 may be suppressed within a satisfactory range. If the scanning speed is not greater than 100 mm/sec, it is possible to prevent the holder 24 that supports the work 4 from falling down.

Figure 4:
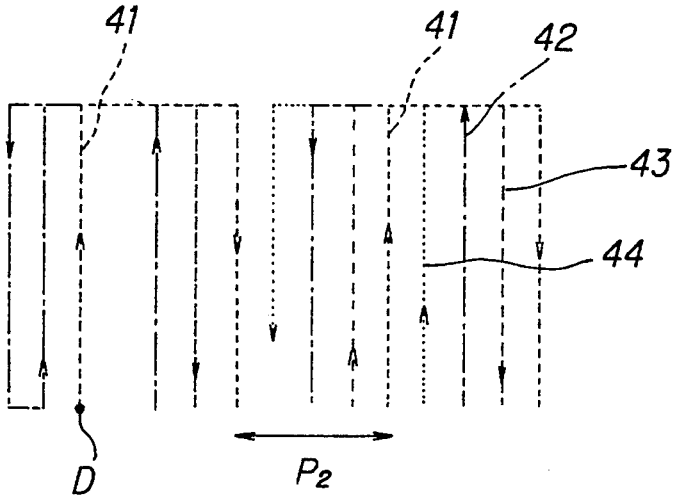
FIG. 4 is an illustration of movement paths of a nozzle according to another embodiment of the invention.

FIG. 4 shows another scanning method of the nozzle according to the present invention. In this embodiment, the scan is carried out twice and a feed pitch P2 during the second scan is twice as long as the feed pitch P1 during the first scan (see FIG. 1). A forward path 43 of the second scan is indicated by dash lines while the return path 44 of the second scan is indicated by dotted lines. As shown, the two scans are such that the forward and return paths 43, 44 of the second scan pass between the forward and return paths 41, 42 of the first scan.

According to this method, it is possible to shorten the scanning time of the etching process since the feed pitch P2 of the second scan is lengthened. In this case, the variation in injection amount of the fine particles 2 may be suppressed. As a result, it is possible to improve the uniformity in etching depth within about ±6%.

In this embodiment, the nozzle 20 is reciprocated or scanned twice. It is however possible to modify this method so that the feed pitch P2 of the return scan is a multiple (N) of the pitch P1 of the forward scan and the number of reciprocating motions or scans is set at N, thereby further improving the uniformity in etching depth. Also, in the foregoing embodiments, while the nozzle 20 is maintained stationary and the work 4 is moved relative to the nozzle 20, it is of course possible to move both the nozzle 20 relative to the fixed work 4 or move the nozzle 20 and work 4 together in some predetermined relationship.

What is claimed is:

1. A powder beam etching method for etching a workpiece by injecting fine particles onto the workpiece through a nozzle, comprising the steps of:

executing a first etching of the workpiece through a first scanning motion attained by moving the nozzle and the workpiece relative to each other in a manner wherein the first scanning motion follows a first path, said first scanning motion comprising movement in a feed pitch direction along the workpiece and scanning movements which pass across the workplaces; and executing a second etching of the workpiece through a return scanning motion attained by moving the nozzle and the workpiece relative to each other in a manner wherein the return scanning motion follows a second path which is different from the first path and which is such that the path of the scanning movements of the second etching which pass across the workpiece, fall in between the path of the scanning movements of the first etching.

2. The method according to claim 1, wherein the first and second etchings are repeated a plurality of times (N) and wherein a second feed pitch (P2) of first and return scanning motions of third to Nth etchings is a multiple of a first feed pitch (P1) of first and return scanning motions of the first and second etchings.

3. The method according to claim 1, wherein a feed pitch (P1) of at least one of said first and return scanning motions falls within a range of 0.5 to 5 mm.

4. The method according to claim 2, wherein said first and second feed pitches fall within a range of 0.5 to 5 mm.

5. The method according to claim 1, wherein a scanning speed of at least one of said first and second scanning motions is in the range of 10 to 100 mm/sec.

6. The method according to claim 2, wherein a scanning speed of at least one of said scanning motions is in the range of 10 to 100 mm/sec.

* * * * *